US007191842B2

(12) United States Patent
Hackworth et al.

(10) Patent No.: US 7,191,842 B2
(45) Date of Patent: Mar. 20, 2007

(54) COLLAPSE RESISTANT EXPANDABLES FOR USE IN WELLBORE ENVIRONMENTS

(75) Inventors: Matthew R. Hackworth, Pearland, TX (US); Craig D. Johnson, Letchworth (GB); Laurent N. Alteirac, Allees du Chablis (FR); Kevin W. Hayes, Missouri City, TX (US); Don Eubank, Sugar Land, TX (US); Joel McClurkin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 286 days.

(21) Appl. No.: 10/387,105

(22) Filed: Mar. 12, 2003

(65) Prior Publication Data

US 2004/0177972 A1 Sep. 16, 2004

(51) Int. Cl.
*E21B 43/08* (2006.01)
*E21B 43/10* (2006.01)
*A61F 2/00* (2006.01)

(52) U.S. Cl. ..... 166/384; 166/207; 623/1.2; 623/1.17

(58) Field of Classification Search ..... 166/207, 166/382, 384; 623/1.17, 1.2
See application file for complete search history.

(56) References Cited

U.S. PATENT DOCUMENTS

| | | | | |
|---|---|---|---|---|
| 1,233,888 | A | 7/1917 | Leonard | |
| 1,301,285 | A | 4/1919 | Leonard | |
| 2,812,025 | A | 11/1957 | Teague et al. | |
| 3,179,168 | A | 4/1965 | Vincent | |
| 3,203,451 | A | 8/1965 | Vincent | |
| 3,353,599 | A | 11/1967 | Swift | |
| 3,389,752 | A | 6/1968 | Lebourg | |
| 3,489,220 | A | 1/1970 | Kinley | |
| 5,348,095 | A | 9/1994 | Worrall et al. | |
| 5,366,012 | A | 11/1994 | Lohbeck | |
| 5,377,823 | A | 1/1995 | Steen et al. | |
| 5,449,382 | A * | 9/1995 | Dayton | 623/1.15 |
| 5,667,011 | A | 9/1997 | Gill et al. | |
| 5,901,789 | A | 5/1999 | Donnelly et al. | |
| 6,022,371 | A * | 2/2000 | Killion | 606/198 |

(Continued)

FOREIGN PATENT DOCUMENTS

| | | |
|---|---|---|
| WO | WO 98/32412 | 7/1998 |

(Continued)

OTHER PUBLICATIONS

Hackworth et al, Development and first application of bistable expandable sand screen, Oct. 5-8, 2003, SPE 84265, whole document.*

(Continued)

*Primary Examiner*—David Bagnell
*Assistant Examiner*—Shane Bomar
(74) *Attorney, Agent, or Firm*—Foley & Lardner LLP; Jamie A. Castano

(57) ABSTRACT

A technique utilizes blocking members to resist contraction of expandables in wellbore environments. The technique comprises an expandable having a wall with a plurality of expandable cells. A plurality of blocking members cooperate with at least some of the cells to resist contraction of the expandable device once transitioned to a desired expanded state.

35 Claims, 10 Drawing Sheets

U.S. PATENT DOCUMENTS

| | | | | |
|---|---|---|---|---|
| 6,029,748 | A | 2/2000 | Forsyth et al. | |
| 6,065,500 | A | 5/2000 | Metcalfe | |
| 6,112,818 | A | 9/2000 | Campbell | |
| 6,253,850 | B1 | 7/2001 | Nazzai et al. | |
| 6,261,318 | B1 * | 7/2001 | Lee et al. | 623/1.15 |
| 6,263,966 | B1 | 7/2001 | Haut et al. | |
| 6,263,972 | B1 | 7/2001 | Richard et al. | |
| 6,478,092 | B2 * | 11/2002 | Voll et al. | 166/378 |
| 6,488,702 | B1 | 12/2002 | Besselink | |
| 6,540,777 | B2 * | 4/2003 | Stenzel | 623/1.16 |
| 6,964,680 | B2 * | 11/2005 | Shanley | 623/1.15 |
| 2002/0046840 | A1 | 4/2002 | Schetky et al. | |
| 2002/0107562 | A1 | 8/2002 | Hart et al. | |
| 2003/0234111 | A1 * | 12/2003 | Echols et al. | 166/382 |

FOREIGN PATENT DOCUMENTS

| | | | |
|---|---|---|---|
| WO | WO 02/25057 | A1 | 3/2002 |
| WO | WO 2004/014255 | | 2/2004 |

OTHER PUBLICATIONS

Besselink, Peter; Biflex Stents; SMST-99: Proceedings of the First European Conference on Shape Memory and Superelastic Technologies, Antwerp Zoo, Belgium, 1999; pp. 142-150.

Docket Sheet for *Memry Corporation* v. *Kentucky Oil Technology, N.V.*, (S.D. Tex.) (PACER Jun. 2, 2005) (5 pages).

Docket Sheet for *Memry Corporation* v. *Kentucky Oil Technology, N.V.*, (N.D. Cal.) (PACER Aug. 11, 2005) (13 pages).

Communication from United States District Court Transferring Case, *Memry Corporation* v. *Kentucky Oil Technology, N.V.*, (S.D. Tex.), dated Sep. 7, 2004 (1 page).

Plaintiffs' Original Complaint, *Memry Corporation* v. *Kentucky Oil Technology, N.V.*, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern District of California, *Memry Corporation* v. *Kentucky Oil Technology, N.V.*, (S.D. Tex.), filed Jul. 7, 2004 (49 pages).

Plaintiff's First Amended Complaint, *Memry Corporation* v. *Kentucky Oil Technology, N.V.*, (N.D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology, N.V.*, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology, N.V.*, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.*, (N.D. Cal.), filed Jan. 24, 2005 (32 pages).

[Proposed] Order Granting Schlumberger Technology Corporation's Motion to Dismiss Kentucky Oil Technology's Third, Fourth, Fifth, and Sixth Counterclaims, *Memry Corporation* v. *Kentucky Oil Technology, N.V.*, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology, N.V.*, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, *Memry Corporation* v. *Kentucky Oil Technology, N.V.*, (N.D. Cal.), filed Feb. 24, 2005 (32 pages).

Request for Judicial Notice in Support of Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.*, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.*, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.*, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology, N.V.*, (N.D. Cal.), filed Feb. 25, 2005 (3 pages).

[Proposed] Order Granting Memry Corporation's Motion to Dismiss Kentucky Oil Technology's Third Fourth, Fifth, and Sixth Counterclaims, *Memry Corporation* v. *Kentucky Oil Technology, N.V.*, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology, N.V.*, (N.D. Cal.), filed Mar. 11, 2005 (29 pages).

Kentucky Oil's Opposition to Counterdefendants' Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology, N.V.*, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology, N.V.*, (N.D. Cal.), filed Mar. 18, 2005 (9 pages).

Plaintiff and Counterdefendant Memry Corporation's Reply in Support of Request for Judicial Notice, *Memry Corporation* v. *Kentucky Oil Technology, N.V.*, (N.D. Cal.), filed Mar. 18, 2005 (4 pages).

Reply of Schlumberger Technology Corporation to Kentucky Oil Technology's Opposition to First Amended, Third, Fourth, Fifth, and Sixth Counterclaims, *Memry Corporation* v. *Kentucky Oil Technology, N.V.*, (N.D. Cal.), filed Mar. 18, 2005 (17 pages).

Schlumberger's Response to Kentucky Oil's Opposition to Counterdefendants' Requests for Judicial Notice, *Memry Corporation* v. *Kentucky Oil Technology, N.V.*, (N.D. Cal.), filed Mar. 18, 2005 (3 pages).

Schlumberger's Notice of Motion and Motion to Strike Exhibits 1, 2, and 4 to the Declaration of Nicola A. Pisano, *Memry Corporation* v. *Kentucky Oil Technology, N.V.*, (N.D. Cal.), filed Mar. 18, 2005 (3 pages).

Kentucky Oil's Opposition to STC's Motion to Strike Exhibits 1, 3 and 4 to the Declaration of Nicola A. Pisano, *Memry Corporation* v. *Kentucky Oil Technology, N.V.*, (N.D. Cal.), filed Mar. 25, 2005 (3 pages).

Kentucky Oil's Notice of Motion and Motion to Strike Declaration of Benjamin Holl and Portions of Counterdefendants' Reply Briefs, *Memry Corporation* v. *Kentucky Oil Technology, N.V.*, (N.D. Cal.), filed Mar. 25, 2005 (4 pages).

[Proposed] Order Granting Kentucky Oil's Motion to Strike Declaration of Benjamin Holl and Portions of Counterdefendants' Reply Briefs, *Memry Corporation* v. *Kentucky Oil Technology, N.V.*, (N.D. Cal.), entered Mar. 25, 2005 (2 pages).

Order Granting in Part and Denying in Part Counterdefendants' Motion to Dismiss, *Memry Corporation* v. *Kentucky Oil Technology, N.V.*, (N.D. Cal.), entered Apr. 8, 2005 (26 pages).

Plaintiff and Counterdefendant Memry Corporation's Reply to Kentucky Oil Technology N.V.'s Counterclaims and Demand for Jury Trial, *Memry Corporation* v. *Kentucky Oil Technology, N.V.*, (N.D. Cal.), filed Apr. 18, 2005 (8 pages).

Second Amended Counterclaims of Kentucky Oil Technology N.V. Against Memry Corporation and Schlumberger Technology Corporation, *Memry Corporation* v. *Kentucky Oil Technology, N.V.*, (N.D. Cal.), filed May 6, 2005 (20 pages).

Plaintiff Memry Corporation's Reply to Kentucky Oil Technology N.V.'s Second Amended Counterclaims and Demand for Jury Trial, *Memry Corporation* v. *Kentucky Oil Technology, N.V.*, (N.D. Cal.), filed Jun. 3, 2005 (9 pages).

Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology, N.V.*, (N.D. Cal.), filed Jun. 3, 2005 (18 pages).

Opposition of Kentucky Oil Technology to Schlumberger Technology Corporation's Motion to Dismiss Kentucky Oil's Second Amended Counterclaims, *Memry Corporation* v. *Kentucky Oil Technology, N.V.*, (N.D. Cal.), filed Jun. 17, 2005 (16 pages).

Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology, N.V.*, (N.D. Cal.), filed Jun. 24, 2005 (11 pages).

Order Granting in Part and Denying In Part STC's Motion to Dismiss, *Memry Corporation* v. *Kentucky Oil Technology, N.V.*, (N.D. Cal.), entered Jul. 14, 2005 (8 pages).

Schlumberger Technology Corporation's Answer to Kentucky Oil Technology's Second Amended Counterclaims, *Memry Corporation* v. *Kentucky Oil Technology, N.V.*, (N.D. Cal.), filed Jul. 28, 2005 (8 pages).

Notice o Motion and Motion by Kentucky Oil To Compel Production of Documents by Schlumberger Technology Coporation Pursuant to Fed. R. Civ. Rule 37; Memorandum of Points and Authorities in Support Thereof; Declaration of Michael Bierman, *Memry Corporation* v. *Kentucky Oil Technology, N.V.*, (N.D. Cal.), filed Jul. 28, 1005 (32 pages).

Schlumberger Technology Corporation's Opposition to Kentucky Oil Technology's Motion to Compel, *Memry Corporation* v. *Kentucky Oil Technology, N.V.*, (N.D. Cal.), filed Aug. 4, 2005 (21 pages).

Declaration of David B. Moyer in Support of Schlumberger Technology Corporation's Opposition to Kentucky Oil Technology's Motion to Compel, *Memry Corporation* v. *Kentucky Oil Technology, N.V.*, (N.D. Cal.), filed Aug. 4, 2005 (52 pages).

Kentucky Oil's Reply in Support of Motion to Compel, *Memry Corporation* v. *Kentucky Oil Technology, N.V.*, (N.D. Cal.), filed Aug. 10, 2005 (18 pages).

Declaration of Nicola A. Pisano in Support of Kentucky Oil's Motion to Compel, *Memry Corporation* v. *Kentucky Oil Technology, N.V.*, (N.D. Cal.), filed Aug. 10, 2005 (69 pages).

Order Granting Kentucky Oil's Motion to Compel Production of Documents, *Memry Corporation* v. *Kentucky Oil Technology, N.V.*, (N.D. Cal.), entered Aug. 17, 2005 (8 pages).

US 6,706,063, 03/2004, Besselink (withdrawn)

* cited by examiner

COLLAPSE RESISTANT EXPANDABLES FOR USE IN WELLBORE ENVIRONMENTS

BACKGROUND

Expandable devices are becoming more common in various wellbore applications. For example, expandable sandscreens have been utilized within wellbores to limit the influx of sand as production fluid flows into the wellbore. The sandscreen typically is moved to a desired downhole location and radially expanded towards the wellbore wall. Generally, once the device is expanded, inadvertent collapse or radial contraction of the device is undesirable.

SUMMARY

According to certain aspects of the present invention, an expandable is provided with a collapse resistant mechanism, such as a blocking member. Thus, various expandables may be transitioned to a desired, expanded state, and the collapse resistant mechanism secures the expanded state.

BRIEF DESCRIPTION OF THE DRAWINGS

Certain embodiments of the invention will be described with reference to the accompanying drawings, wherein like reference numerals denote like elements, and.

DETAILED DESCRIPTION

Figure 1:
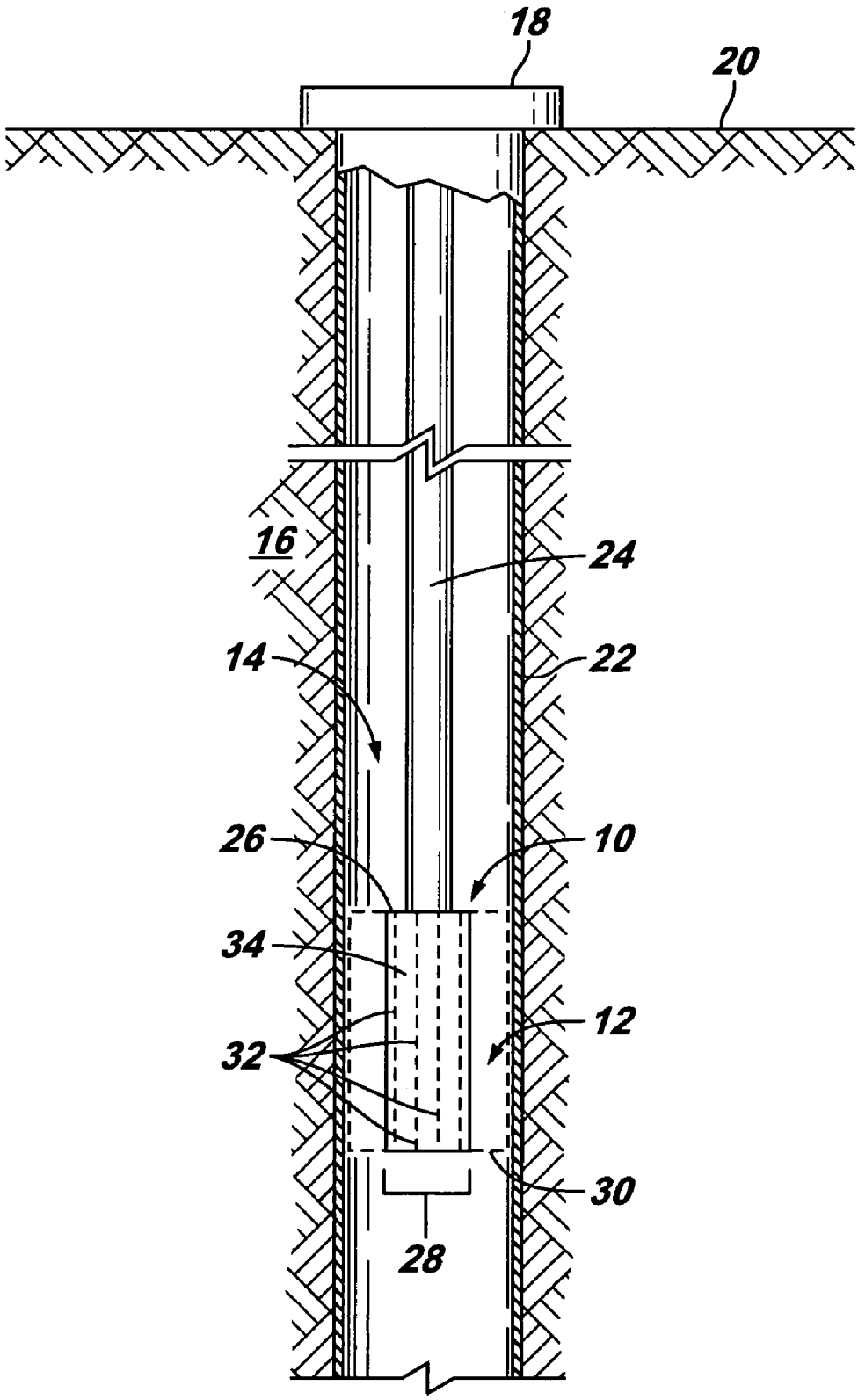
FIG. 1 is a front elevational view of an embodiment of an expandable deployed in a wellbore, according to one embodiment of the present invention.

Referring generally to FIG. 1, an embodiment of an expandable 10 is illustrated at a location 12 within a wellbore 14. Wellbore 14 may be, for example, a horizontal or vertical wellbore formed in a geological formation 16.

In the embodiment illustrated, wellbore 14 extends from a wellhead 18 disposed at, for example, a surface 20 of the earth. The illustrated wellbore 14 is lined by a wellbore casing 22. However, expandable 10 may be deployed within a line or unlined section of the wellbore. Additionally, expandable 10 may be deployed to desired locations within wellbore 14 by a variety of deployment systems 24, such as coiled tubing, cable or drill pipe.

Expandable 10 is representative of a variety of expandable devices. For example, expandable 10 may comprise an expandable tubular 26, such as a sandscreen or a liner. The expandable 10 is transitioned between a contracted state 28 and an expanded state 30, as represented by the dashed line in FIG. 1. If expandable 10 is, for example, a sandscreen or a liner, an appropriate expansion tool, such as a mandrel or radially expandable tool, is used to radially expand the tubular towards the wall of wellbore 14.

Expansion of device 10 may be facilitated by forming a plurality of cells 32 in a structural wall 34 of the expandable, e.g. expandable tubular 26. Cells 32 may be utilized to facilitate transition of expandable 10 from the contracted or collapsed state 28 to the expanded state 20. Some examples of cells 32 comprise openings formed through wall 34. The openings may be formed through wall 34 in a variety of patterns and a variety of shapes including circular, out-of-round, triangular, oval, elliptical, square, rectangular, diamond or other appropriate shapes. Additionally, each cell 32 may be formed as a simple straight slot, a curvilinear slot, a complex slot or a plurality of slots.

The slots used to form cells 32 also may be arranged to form cells that are bistable. Bistable cells are cells that have two stable configurations. For example, the bistable cell may be stable in a contracted or collapsed position. However, when force is applied to expand the cell, the force is increased to a maximum at the onset of shifting from one stable configuration to the other. Further deflection requires less force because the cell has a negative spring rate. Depending on the cell design, when the expansion force becomes zero, the deflection to the second stable position, e.g. fully expanded position, may be spontaneous.

Regardless of the specific cell type, maintaining the expandable 10 in its expanded state is desirable in many applications. Accordingly, collapse resistant mechanisms in the form of blocking members have been incorporated into expandable 10 proximate some or all of the cells 32.

Figure 2:
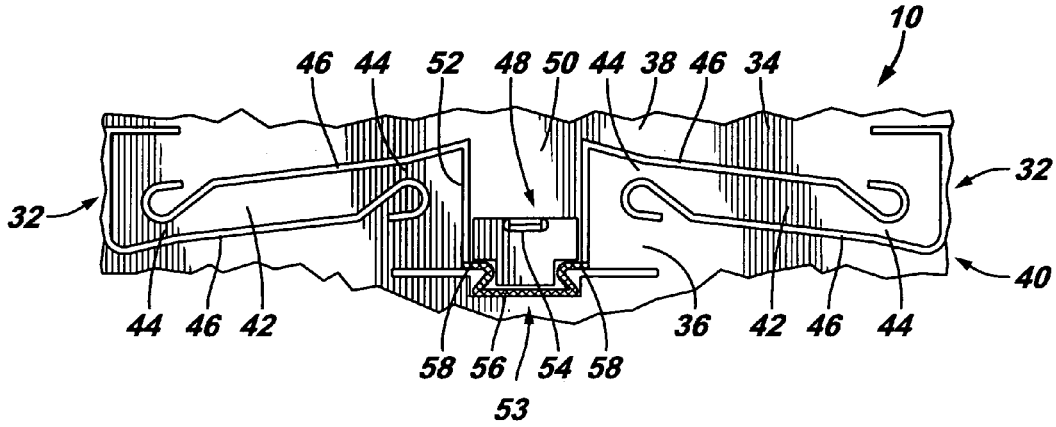
FIG. 2 illustrates an embodiment of a collapse resistant mechanism incorporated into an expandable.
Figure 3:
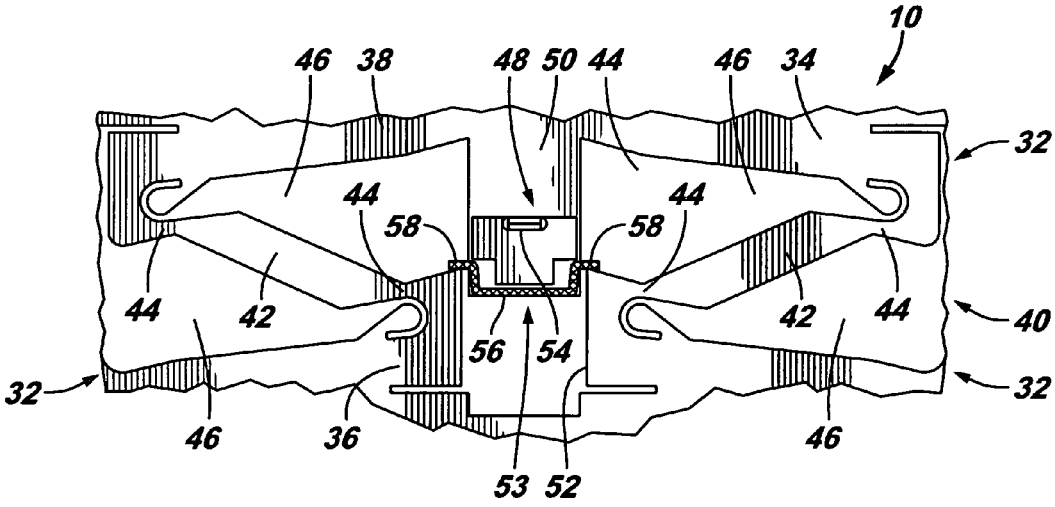
FIG. 3 is a view similar to FIG. 2 in which the collapse resistant mechanism has been actuated.

Referring generally to FIGS. 2 and 3, one example of a cell 32 deployed in wall 34 is illustrated.

In FIG. 2, the cell 32 is illustrated in a collapsed state, and in FIG. 3, cell 32 is illustrated in an expanded state. In this particular example, each cell 32 comprises a base portion 36 and a corresponding portion 38 coupled to each other by a linkage 40. By way of example, linkage 40 may comprise a pair of arms 42 each coupled between base portion 36 and corresponding portion 38 by pivot sections 44. Arms 42 are defined by appropriately cut slots 46 (see FIG. 2) formed through wall 34 that separate as the cell 32 is transitioned from its contracted to its expanded state (see FIG. 3).

A collapse resistant or blocking member 48 is utilized to resist or prevent collapse of one or more cells 32 when the cell or cells 32 are transitioned to the expanded state. In the embodiment illustrated, blocking member 48 is automatically actuated to move into an interfering position between base portion 36 and corresponding portion 38 when cells 32 are transitioned to the expanded state. Thus, collapse of expandable 10 is resisted.

In the cell embodiment illustrated, corresponding portion 38 comprises a tongue 50 disposed in a receiving slot 52 formed in base portion 36. Blocking member 48 comprises a separate insert 53 mounted to a distal end of tongue 50 by a bracket 54, e.g. a protrusion fitted in a corresponding opening in tongue 50. The insert 53 comprises a resilient member, such as a spring clip 56 having at least one spring tab 58, e.g. a pair of opposed spring tabs 58, compressed within receiving slot 52 when expandable 10 is in the collapsed state.

As cell 32 and expandable 10 are expanded, tongue 50 draws blocking member 48, including spring clip 56, outwardly through receiving slot 52 until the expanded state is achieved. At this stage, blocking member 48 is automatically actuated when spring clip 56 forces spring tabs 58 outwardly beyond the defining walls of receiving slot 52 and into interference with cell features. In the embodiment illustrated, the spring tabs 58 lodge between the distal end of tongue 50 and the walls defining receiving slot 52 to create the interference that blocks contraction or collapse of cell 32. The utilization of blocking members 48 in multiple cells 32 resists or prevents contraction of expandable 10 once the expanded state is reached.

Figure 4:
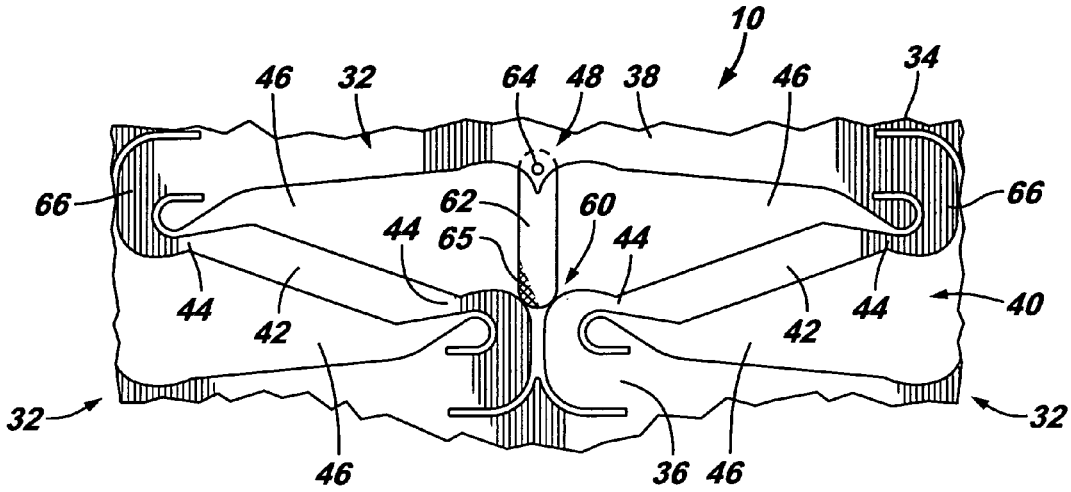
FIG. 4 illustrates an alternate embodiment of the collapse resistant mechanism illustrated in FIG. 2.

Referring generally to FIG. 4, another embodiment of cell 32 and blocking member 48 is illustrated. In this embodiment, cell 32 is illustrated as having arms 42 coupled between base portion 36 and corresponding portion 38. However, tongue 50 and receiving slot 52 have been replaced by a landing 60. Additionally, blocking member 48 comprises a peg 62 automatically biased into engagement with landing 60 when cell 32 and expandable 10 are transitioned to the expanded state, as illustrated in FIG. 4. Peg 62 may be formed as a separate insert pivotably attached to wall 34 or to another portion of expandable 10.

In the specific embodiment illustrated, peg 62 is pivotably mounted to corresponding portion 38 by a pivot 64, e.g. a pin received in a corresponding opening, and landing 60 is formed on base portion 36 generally opposite pivot 64. Pivotable peg 62 may be mounted within wall 34 such that as slots 46 are expanded, peg 62 moves towards landing 60. When the expandable 10 and cell 32 reach the expanded state, a distal end 65 of peg 62 opposite pivot 64 is nested in landing 60. In this orientation, peg 62 is aligned in an interfering position between base portion 36 and corresponding portion 38 to resist collapse of cell 32 and expandable 10.

Figure 5:
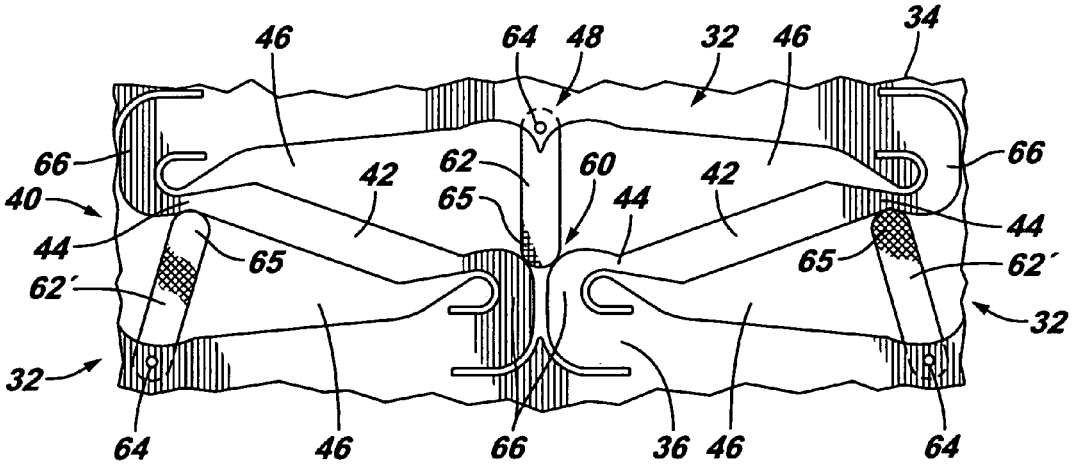
FIG. 5 illustrates another embodiment of the collapse resistant mechanism illustrated in FIG. 2.

The collapse resistance of expandable 10 can be supplemented, if desired, by adding additional blocking members. For example, a plurality of pegs 62, e.g. three pegs 62, may be mounted in adjacent cells 32, as illustrated in FIG. 5. In this embodiment, a pair of additional pegs 62' are pivotably mounted to wall 34 on an opposite side of arms 42 from peg 62 such that the distal end 65 of each peg 62' pivots into engagement with a recessed area formed at the outlying pivots 44. Specifically, the distal ends are landed in a region where each arm 42 is coupled to corresponding portion 38 via, for example, flexible horns 66. It should be noted that other embodiments of cells 32 do not utilize flexible horns, however flexible horns 66 are useful in some types of bistable cells to permit the transition of arms, e.g. arms 42, from a collapsed state to an expanded state without undo flexing of the arms.

Figure 6:
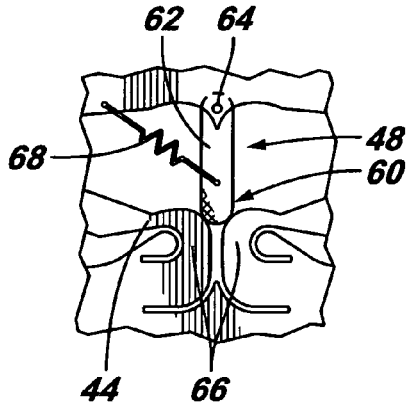
FIG. 6 illustrates a collapse resistant mechanism similar to FIG. 4 with an added spring-biasing element, according to an embodiment of the present invention.

Pegs 62 may be biased towards their desired interfering position as the corresponding cell 32 is expanded. The biasing force can be provided by a variety of mechanisms, including orienting the peg 62 and pivot 64 such that gravity acts on the peg and causes movement of the peg to the desired interfering position. Alternatively, a biasing member 68 may be utilized, as illustrated in FIG. 6. Biasing member 68 may comprise a spring coupled between peg 62 and one or both of base portion 36 and corresponding portion 38. The biasing member 68 is mounted such that pressure or tension is applied to peg 32 when the corresponding cell 32 is in the contracted or collapsed state. As the expandable 10 is moved to expanded state 30, biasing member 68 pulls or pushes peg 62 toward its interfering position.

Figure 7:
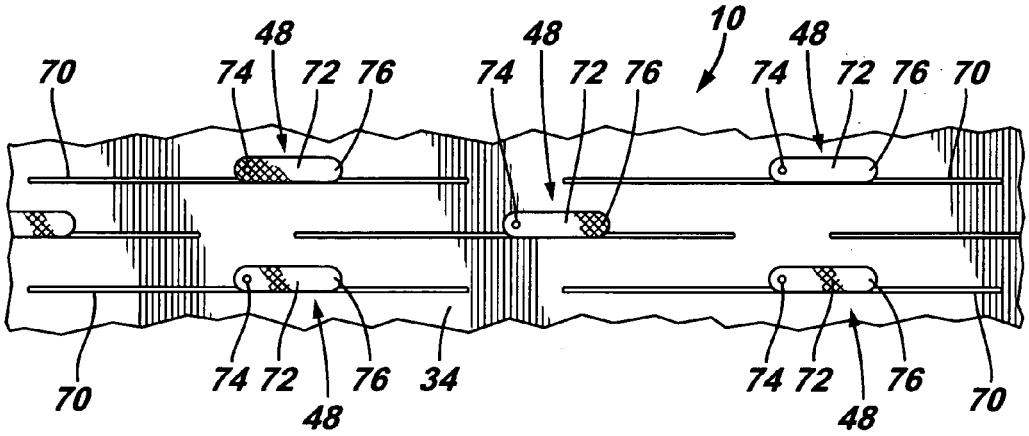
FIG. 7 illustrates another embodiment of an expandable with an incorporated collapse resistant mechanism.
Figure 8:
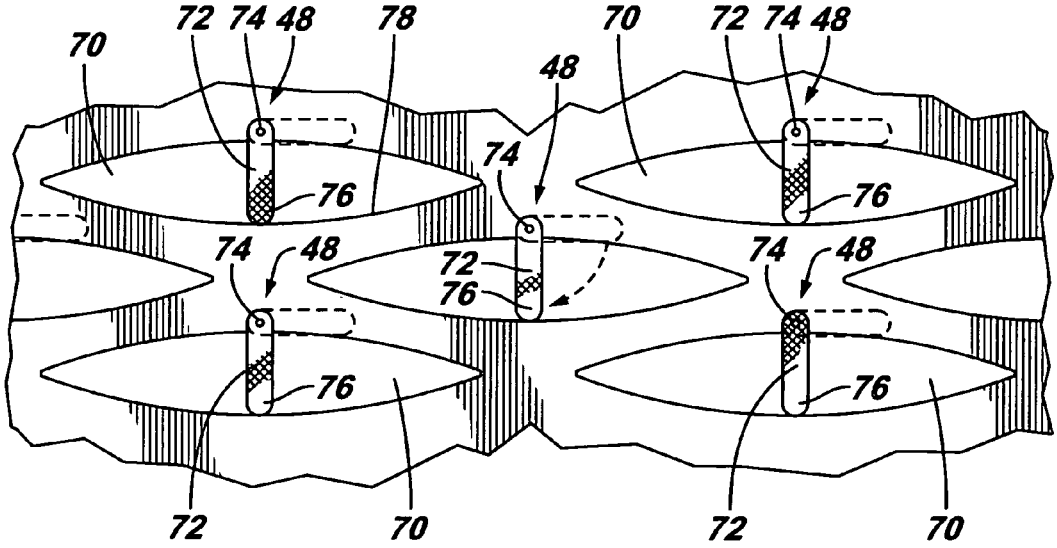
FIG. 8 is a view similar to FIG. 7 with the expandable transitioned to an expanded state.

Referring generally to FIGS. 7 and 8, another embodiment of expandable 10 is illustrated. In this embodiment, wall 34 comprises a plurality of cells in the form of generally linear slots 70 formed through wall 34. A collapse resistant mechanism 48 is disposed adjacent each linear slot 70 such that the mechanism is able to move automatically into an interfering position once the cells 32 are transitioned from a collapsed state (see FIG. 7) to an expanded state (see FIG. 8).

In this particular embodiment, each blocking mechanism 48 comprises a peg 72 that may be a separate insert pivotably mounted to wall 34 via a pivot 74. As expandable 10 is transitioned to its expanded state, a distal end 76 of each peg slides along a slot wall 78 on an opposite side of the cell 32 from pivot 74. The peg 72 is biased to an interfering position in which each peg 72 is oriented generally perpendicular to the orientation of each linear slot 70 prior to expansion. The peg 72 may be held in this interfering position by friction, a biasing member or by mechanical features mounted on or formed along the slot wall 78. Such a collapse resistance system works well with a variety of expandables, such as expandable slotted liners.

Figure 9:
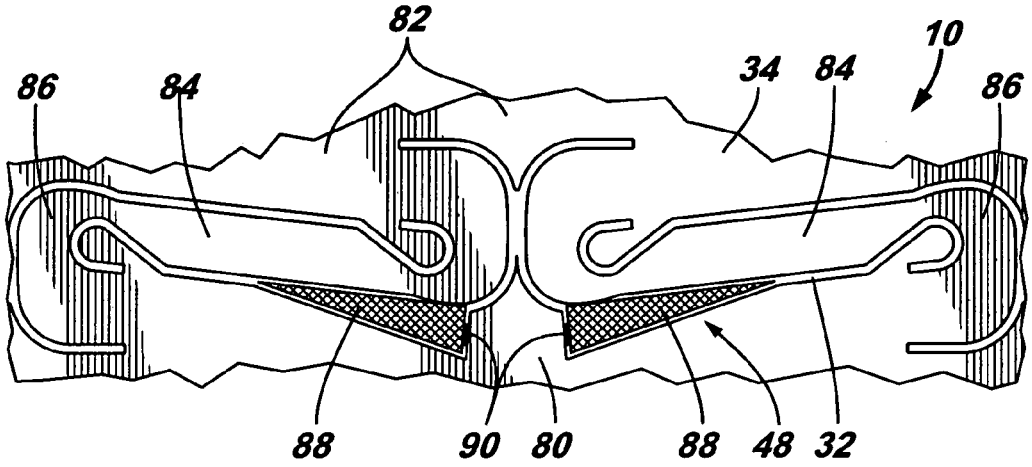
FIG. 9 illustrates another embodiment of an expandable with an incorporated collapse resistant mechanism.
Figure 10:
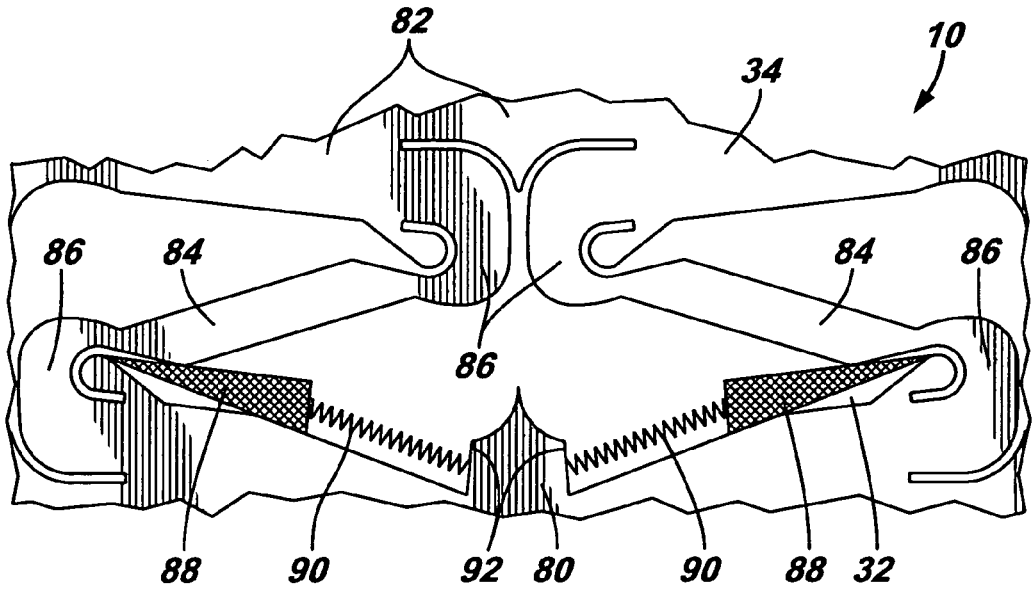
FIG. 10 is a view similar to FIG. 9 illustrating the expandable in an expanded state.

Referring generally to FIGS. 9 and 10, another embodiment of expandable 10 is illustrated. In this embodiment, wall 34 comprises a plurality of cells 32, such as bistable cells. For example, a base portion 80 may be coupled to a corresponding portion 82 by arms or links 84 coupled between flexible horns 86. Collapse resistant or blocking mechanism 48 comprises movable wedges 88 deployed in individual cells or combinations of cells.

Wedges 88 are biased toward an interfering position by an appropriate actuator, such as a spring or linkage. As expandable 10 and cells 32 are transitioned from a contracted state (see FIG. 9) to an expanded state (see FIG. 10), the wedges 88 are moved to an interfering position. For example, the actuation may be provided by a spring member 90 deployed between each wedge 88 and a portion 92 of wall 34. As cells 32 are transitioned to an expanded state, as illustrated in FIG. 10, wedges 88 are forced into interfering positions between, for example, arms 84 and base portion 80.

Figure 11:
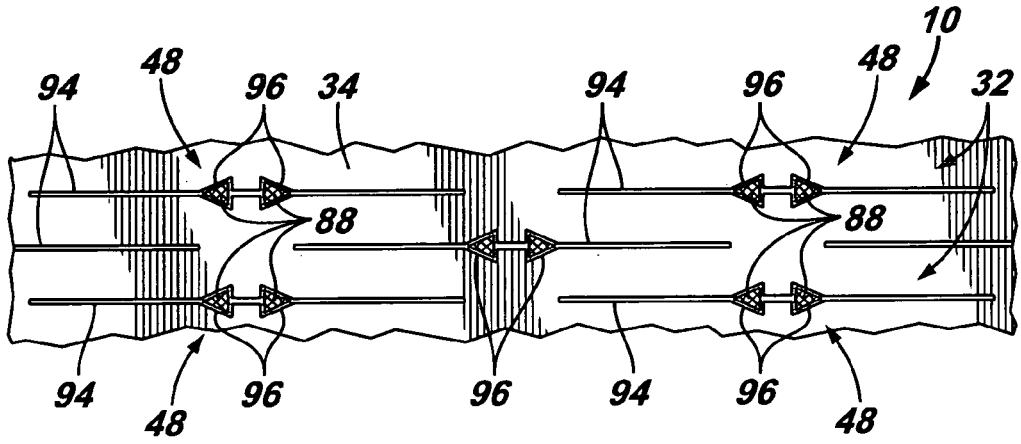
FIG. 11 illustrates another embodiment of an expandable with an incorporated collapse resistant mechanism.
Figure 12:
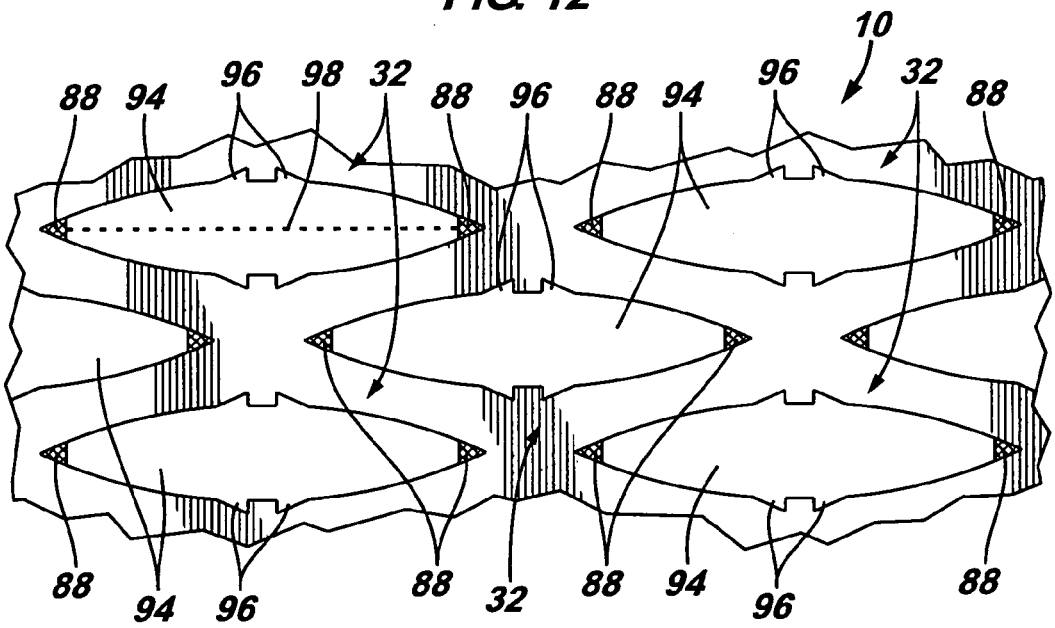
FIG. 12 illustrates the expandable of FIG. 11 in an expanded state.

Another embodiment of the wedge style blocking member is illustrated in FIGS. 11 and 12. In this embodiment, cells 32 are formed as slots 94. For example, slots 94 may be generally linear when in the collapsed state, as illustrated in FIG. 11. Slots 94 also may comprise one or more expanded regions 96 to receive wedges 88. The wedges 88 are biased towards an interfering position when the slots 94 are opened to an expanded state, as illustrated in FIG. 12. For example, wedges 88 may be pushed toward opposing ends of each slot 94 by an appropriate actuator, such as a spring member 98 (see FIG. 12). Alternatively, the wedges 88 may be moved by a pulling bias, such as a spring or other actuator coupled in tension between wedges of adjacent cells 32. Regardless of the type of actuation, the wedges 88 are moved into an interfering position when cells 32 and expandable 10 are transitioned to an expanded state. Thus, the wedges are able to resist collapse of the expandable.

Figure 13:
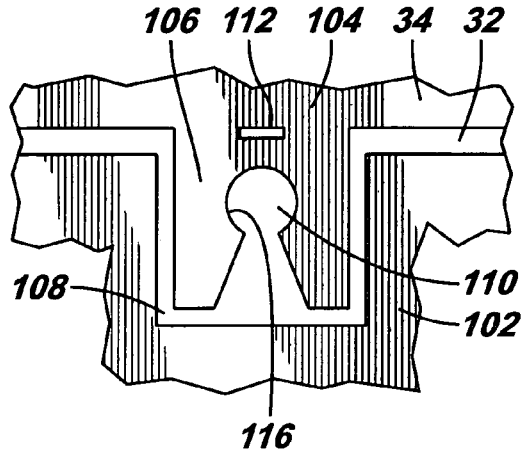
FIG. 13 illustrates another embodiment of an expandable cell utilized in an expandable, according to an embodiment of the present invention.
Figure 14:
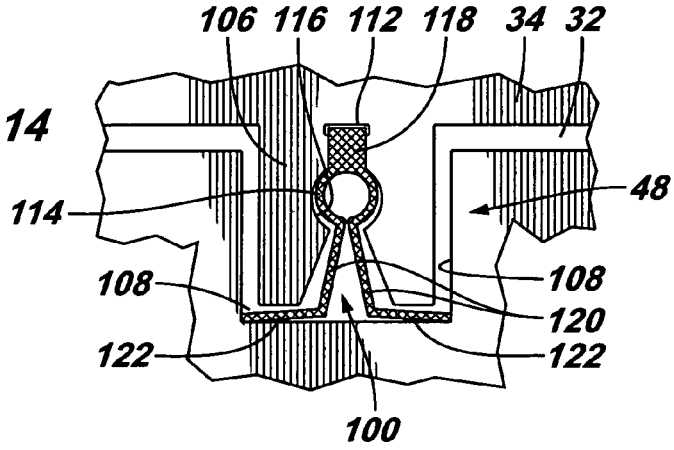
FIG. 14 is a view similar to FIG. 13 with an embodiment of a blocking member added to the cell illustrated in FIG. 13.
Figure 15:
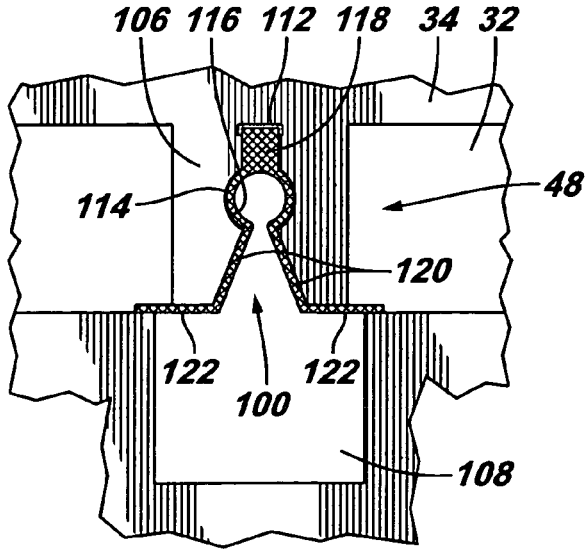
FIG. 15 is a view similar to FIG. 14 with the cell in an expanded state.

Referring next to FIGS. 13, 14 and 15, another embodiment of blocking member 48 is illustrated. In this embodiment, wall 34 of expandable 10 is formed into multiple cells 32, and at least a plurality of the available cells 32 are combined with a spring clip 100 that may be formed as a separate insert insertable into desired cells 32. In this particular embodiment, each cell 32 comprises a base portion 102 and a corresponding portion 104. Corresponding portion 104 has a tongue 106 sized for receipt in an open receiving region 108. Tongue 106, in turn, comprises a generally keyhole-shaped opening 110 and a retention recess 112.

As illustrated best in FIGS. 14 and 15, spring clip 100 has an arcuate spring member 114 sized to fit within a corresponding arcuate portion 116 of keyhole-shaped opening 110. Spring clip 100 further comprises a retention tab 118 that extends from arcuate spring member 116 into retention recess 112. Additionally, spring clip 100 comprises a pair of legs 120 coupled between arcuate spring member 116 and a pair of blocking tabs 122.

When cells 32 are contracted, as illustrated in FIG. 14, blocking tabs 122 are retained within receiving region 108, and arcuate spring member 116 is flexed. However, as the cells 32 are transitioned to an expanded state, as illustrated in FIG. 15, arcuate spring member 116 forces blocking tabs 122 outwardly beyond the confines of receiving region 108. In this expanded position, blocking tabs 122 interfere with movement of tongue 106 into receiving region 108. Thus, collapse of wall 34 and the overall expandable 10 is resisted.

Figure 16:
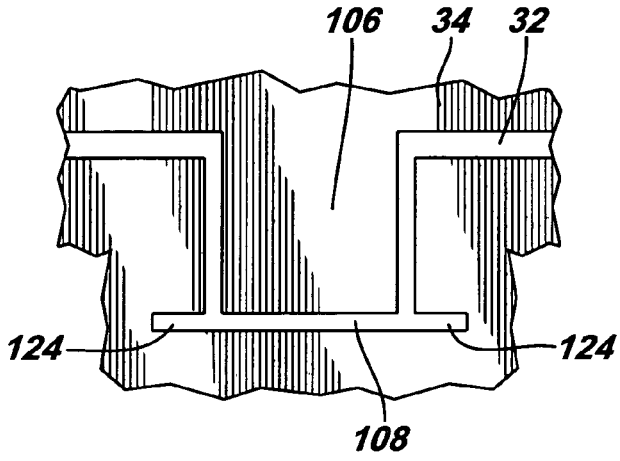
FIG. 16 is another embodiment of a cell utilized in an expandable, according to an embodiment of the present invention.

Another embodiment of blocking member 48 is illustrated with reference to FIGS. 16, 17 and 18. In this embodiment, cells 32 are again formed with tongue 106 received in a corresponding receiving region 108, as illustrated in FIG. 16. However, receiving region 108 comprises at least one outwardly extending retention slot 124. For example, a pair of opposed retention slots 124 may be utilized.

A slightly modified version of spring clip 100 is slidably received in retention slots 124. In this embodiment, for example, spring clip 100 comprises a base 126 having opposed retention tabs 128 that are slidably received in retention slots 124 and held in place by an abutment tab 130. The spring clip further comprises a pair of spring legs 132 that extend from base 126 to corresponding interfering corners 134. Interfering corners 134 are formed by tabs 136 that extend outwardly from spring legs 132.

Figure 17:
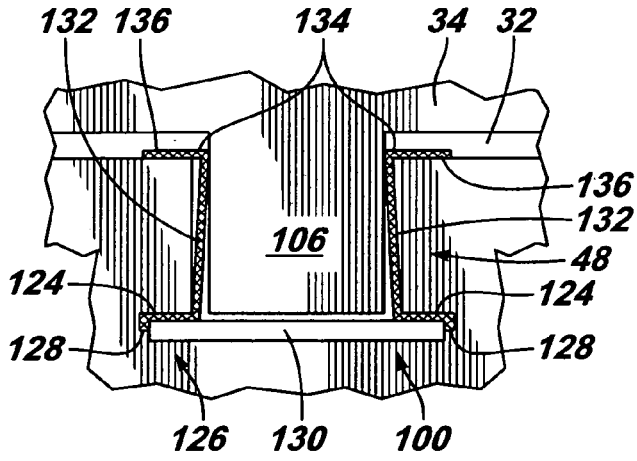
FIG. 17 is a view similar to FIG. 16 with an embodiment of a blocking member added.
Figure 18:
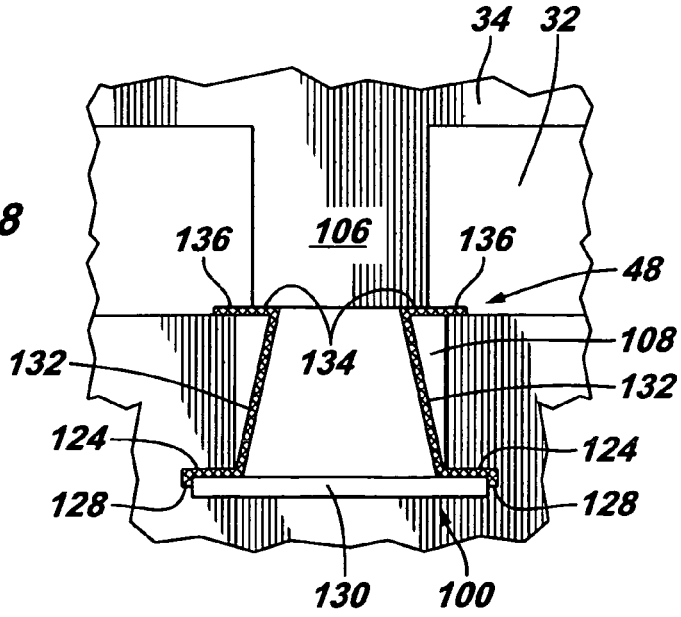
FIG. 18 is a view similar to FIG. 17 with the cell in an expanded state.

In the contracted state, as illustrated in FIG. 17, spring legs 132 are flexed apart to permit insertion of tongue 106 therebetween. When, however, tongue 106 is withdrawn from receiving region 108 during expansion of cells 32, spring legs 132 automatically move interfering corners 134 towards each other to prevent reentry of tongue 106 into receiving region 108. Accordingly, the contraction of cells 32 and expandable 10 is resisted by the spring clip, as illustrated in FIG. 18. It should be noted that the spring clip designs are illustrative, and the corresponding description should not be construed in a limiting fashion. For example, the spring clip may comprise a pair of spring legs and corresponding interfering corners, or it may utilize single or multiple spring leg(s) with corresponding interfering corners.

Figure 19:
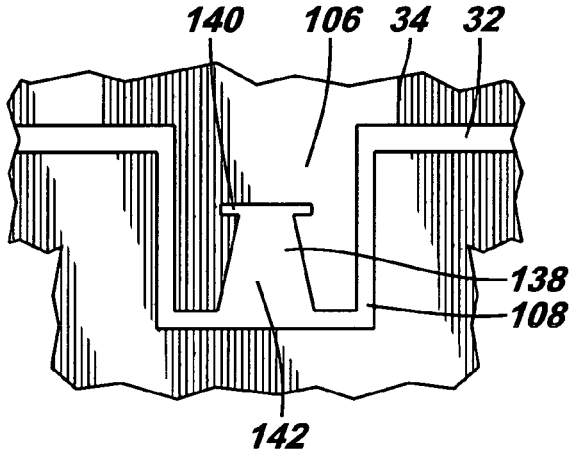
FIG. 19 is another embodiment of a cell utilized in an expandable.

Another embodiment of blocking member 48 is illustrated with reference to FIGS. 19, 20 and 21. In this embodiment, an altered version of spring clip 100 is utilized to resist collapse of an expandable. As with embodiments described above, tongue 106 is received in a receiving region 108, and spring clip 100 is formed as a separate insert slidably received in an opening 138 formed in tongue 106. Opening 138 comprises a retention slot 140 and a throat region 142 that extends from retention slot 140 through the distal end of tongue 106, as best illustrated in FIG. 19.

In this embodiment, spring clip 100 comprises a retention tab 144 sized for slidable receipt in retention slot 140. An abutment tab 146 holds the spring clip in position within opening 138. The spring clip 100 further comprises at least one spring leg 148, e.g. a pair of spring legs 148, that extend from retention tab 144 to outwardly extending interference tabs 150.

Figure 20:
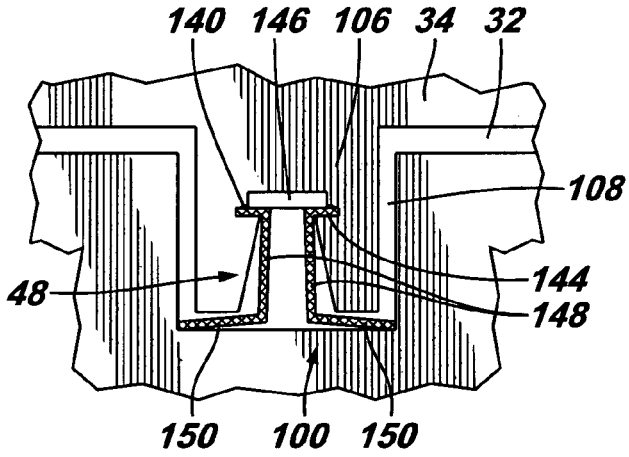
FIG. 20 is a view similar to FIG. 19 with an embodiment of a blocking member added to the expandable cell.
Figure 21:
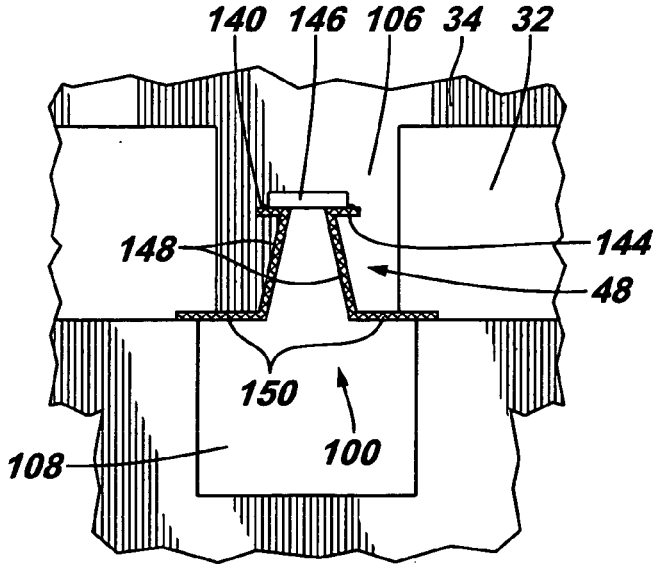
FIG. 21 is a view similar to FIG. 20 with the cell in an expanded state.

When cells 32 are in a contracted state, as illustrated in FIG. 20, spring legs 148 are flexed toward one another such that interference tabs 150 are contained within receiving region 108. However, when expandable 10 and cells 32 are transitioned to an expanded state, the interference tabs 150 are withdrawn from receiving region 108. Upon withdrawal of interference tabs 150, spring legs 148 force the interference tabs 150 outwardly to a position of interference between tongue 106 and the portion of expandable wall 34 defining receiving region 108. Accordingly, insertion of tongue 106 into receiving region 108 as well as collapse of expandable 10 is resisted.

Figure 22:
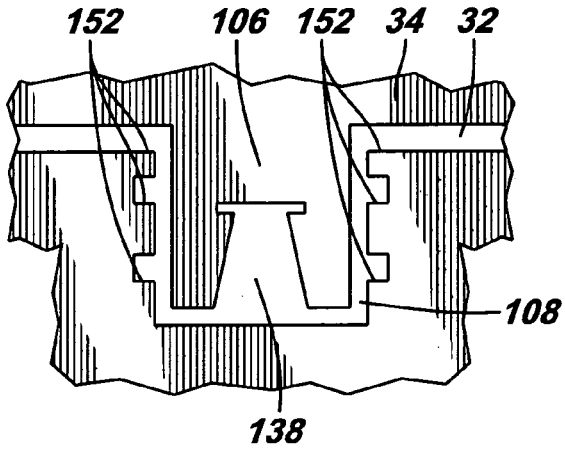
FIG. 22 is another embodiment of a cell utilized in an expandable, according to an embodiment of the present invention.
Figure 23:
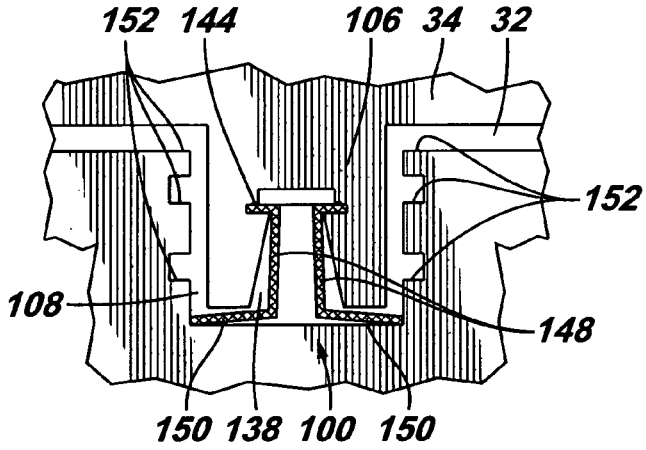
FIG. 23 is a view similar to FIG. 22 with an embodiment of a blocking member combined with the expandable cell.
Figure 24:
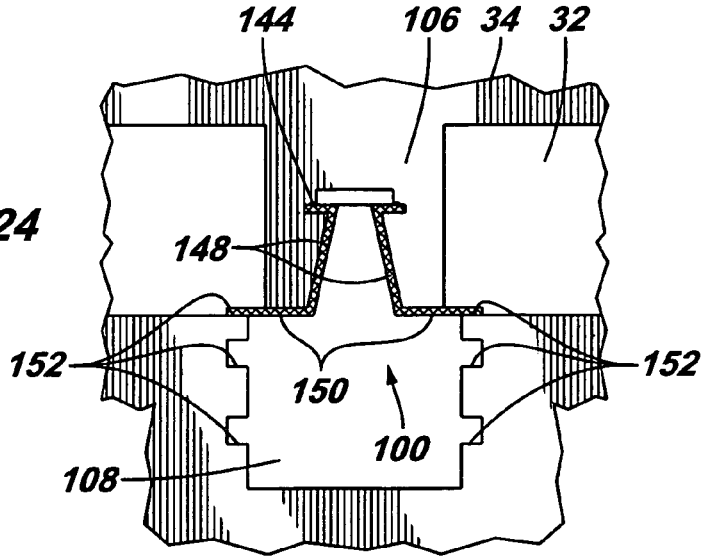
FIG. 24 is a view similar to FIG. 23 with the expandable cell in an expanded state.

Although the blocking members have been described as moving to a position of interference upon complete expansion of the expandable, the system also may be designed to provide a plurality of collapse resistant locations. For example, if a spring clip style blocking member is utilized, a plurality of interference locations 152 can be created, as illustrated in FIGS. 22, 23 and 24. For purposes of explanation, the interference locations 152 are illustrated and described for use with a spring clip 100, such as the spring clip illustrated in FIGS. 20 and 21. However, a variety of spring clips and other blocking members can be utilized in a system having multiple interference locations 152.

In the embodiment illustrated, interference locations 152 are created along the portion of wall 34 defining receiving region 108. When expandable 10 and its cells 32 are in a contracted state, as illustrated in FIG. 23, the spring clip 100 is held in a flexed state within receiving region 108, as described above. As the cells 32 are separated, however, the interference tabs move sequentially through each interference location 152. If the expansion of expandable 10 is obstructed or otherwise limited, the interference locations 152 cooperate with the spring clip or other blocking member to resist or prevent complete return to the collapsed state. For example, during expansion of an expandable sandscreen within a wellbore, the surface of the wellbore may not allow uniform expansion. With graduated interference locations 152, collapse of the sandscreen is resisted even in regions of the sandscreen that were not fully expanded.

In the description above, several types of blocking mechanisms 48 have been illustrated in combination with expandables utilizing various expandable cells. Many of the blocking mechanisms are automatically moved into interfering positions as the cells are transitioned to the desired expanded state. However, the exact design of the expandable, expandable cells and blocking mechanisms can vary. For example, bistable and non-bistable cells may be utilized; the expandable may comprise an expandable liner, sandscreen or other expandable device for use in a wellbore; the blocking mechanisms can be attached to the walls forming the cells that are expanded, e.g., to the wall of a sandscreen base pipe that is expanded; and the blocking members can be attached to other layers of the expandable for interaction with a desired structural layer, e.g. base pipe, that is to be expanded.

While the invention may be susceptible to various modifications and alternative forms, specific embodiments have been shown by way of example in the drawings and described in detail herein. However, it should be understood that the invention is not intended to be limited to the particular forms disclosed.

What is claimed is:

1. A system, comprising:

an expandable tubular having a wall with a plurality of bistable cells that change from a stable collapsed state to a stable expanded state during expansion of the expandable tubular, the expandable tubular further comprising a blocking member, disposed in the wall, that shifts position upon reaching the expanded state to further resist return of the cells to the stable collapsed state.

2. The system as recited in claim 1, wherein the blocking member comprises a spring clip.

3. The system as recited in claim 1, wherein the blocking member comprises a peg.

4. The system as recited in claim 1, wherein the blocking member comprises a movable wedge.

5. The system as recited in claim 3, wherein the peg is spring biased.

6. The system as recited in claim 3, wherein the peg comprises a pivoting peg.

7. The system as recited in claim 2, wherein the spring clip comprises a tab that flexes outwardly into an interfering position between a pair of cell features in each of the plurality of cells upon reaching the expanded state.

8. The system as recited in claim 1, wherein the expandable tubular comprises a sandscreen.

9. The system as recited in claim 1, wherein the plurality of cells comprises slots.

10. The system as recited in claim 1, wherein each cell of the plurality of cells comprises an opening formed through a wall of the expandable tubular.

11. An expandable system for use in a wellbore, comprising:

a wellbore expandable having a wall with a plurality of cells, each cell comprising a bistable cell having a stable collapsed state and a stable expanded state; and a contraction blocking mechanism comprising a plurality of separate inserts, wherein upon transitioning the wellbore expandable toward an expanded state, at least a plurality of the bistable cells transition to the stable expanded state, and at least a portion of the plurality of separate inserts are moved into an interfering relationship with the plurality of cells to further resist collapse of the plurality of bistable cells once the wellbore expandable is expanded.

12. The expandable system as recited in claim 11, wherein the wellbore expandable comprises an expandable tubular.

13. The expandable system as recited in claim 11, wherein each separate insert comprises a spring clip having a tab that is biased into a position between cell features when the wellbore expandable is transitioned to the expanded state.

14. The expandable system as recited in claim 11, wherein each separate insert comprises a peg that automatically moves into a position between cell features when the wellbore expandable is transitioned to the expanded state.

15. The expandable system as recited in claim 12, wherein each separate insert comprises a wedge that moves into a position between cell features when the wellbore expandable is transitioned to the expanded state.

16. The expandable system as recited in claim 12, wherein each separate insert comprises a spring clip having a tab that is biased into a position between cell features when the wellbore expandable is transitioned to the expanded state.

17. The expandable system as recited in claim 12, wherein each separate insert comprises a peg that automatically moves into a position between cell features when the wellbore expandable is transitioned to the expanded state.

18. The expandable system as recited in claim 12, wherein the expandable tubular comprises a sandscreen.

19. The expandable system as recited in claim 12, wherein the expandable tubular comprises a liner.

20. The expandable system as recited in claim 11, wherein each cell comprises a radial opening formed through the wall.

21. A method of making an expandable tubular, comprising:

forming a plurality of bistable cells through a wall of an expandable tubular wherein the plurality of bistable cells change from a stable collapsed state to a stable expanded state during expansion of the expandable tubular;

placing a plurality of contraction blocking members adjacent the plurality of bistable cells; and biasing at least a portion of the plurality of contraction blocking members to move into an interfering position within the plurality of bistable cells to further resist collapse of the plurality of bistable cells once the expandable tubular is expanded.

22. The method as recited in claim 21, wherein biasing comprises spring biasing.

23. The method as recited in claim 21, wherein placing comprises compressing a plurality of spring clips within the wall for subsequent expansion into the interfering position.

24. The method as recited in claim 21, wherein biasing comprises biasing each of the plurality of contraction blocking members into at least one of a plurality of interfering positions.

25. The method as recited in claim 21, wherein placing comprises placing a pivotable peg proximate each of the plurality of bistable cells for pivotable movement into the interfering position.

26. The method as recited in claim 21, wherein forming comprises forming a plurality of slots.

27. A system of making an expandable tubular, comprising:

means for forming an expandable tubular having a plurality of bistable cells that change from a stable collapsed state to a stable expanded state during expansion of the expandable tubular; and means for further resisting contraction of the expandable tubular by moving a blocking member into an interfering position within a wall of the expandable tubular upon movement of the expandable tubular wall to an expanded state.

28. The system as recited in claim 27, wherein the means for forming comprises a plurality of bistable cells through the expandable tubular wall.

29. The system as recited in claim 27, wherein the means for blocking comprises a spring clip.

30. The system as recited in claim 27, wherein the means for blocking comprises a pivoting peg.

31. A system comprising:

an expandable tubular having a tubular wall with a plurality of bistable cells being stable in a first collapsed state and a second expanded state, and a plurality of spring clips mounted in the tubular wall in the compressed state prior to expansion of the expandable tubular, wherein upon sufficient expansion of the expandable tubular, at least a portion of the bistable cells transition to the stable expanded state and at least a portion of the plurality of spring clips transition to an interfering position to further resist collapse of the expandable tubular.

32. The system as recited in claim 31, wherein the plurality of spring clips comprises a spring clip having an arcuate spring.

33. The system as recited in claim 31, wherein the plurality of spring clips comprises a spring clip having a pair of interfering corners.

34. The system as recited in claim 31, wherein the plurality of spring clips comprises a spring clip having a pair of interfering tabs.

35. The system as recited in claim 31, wherein the plurality of spring clips comprises a spring clip expandable into a plurality of interfering positions.

* * * * *